US008393723B2

(12) United States Patent
Long

(10) Patent No.: US 8,393,723 B2
(45) Date of Patent: Mar. 12, 2013

(54) BUBBLE PURGING SYSTEM FOR A FLUID EJECTION HEAD

(75) Inventor: Gregory Alan Long, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/450,530

(22) Filed: Apr. 19, 2012

(65) Prior Publication Data

US 2012/0200623 A1 Aug. 9, 2012

Related U.S. Application Data

(62) Division of application No. 12/618,042, filed on Nov. 13, 2009, now abandoned.

(51) Int. Cl.
*B41J 2/19* (2006.01)
*B41J 2/165* (2006.01)

(52) U.S. Cl. ..... 347/92; 347/19; 347/30

(58) Field of Classification Search ..... None
See application file for complete search history.

(56) References Cited

U.S. PATENT DOCUMENTS

2009/0058920 A1* 3/2009 Endo et al. ..... 347/19
2010/0053258 A1* 3/2010 Seino et al. ..... 347/30

* cited by examiner

*Primary Examiner* — Jerry Rahll

(57) ABSTRACT

A method and system for purging bubbles from a fluid ejection head comprising a plurality of fluid flow channels including a first plurality of fluid flow channels flowing a first ink to a first actuator device and a second plurality of fluid flow channels for flowing a second ink to a second actuator device. During a bubble purging operation the first and second actuator devices are pulsed with different energies that depend on the viscosity of the first ink and the second ink. Heating the inks with different energies, results in the viscosity of the first ink to be same as the viscosity of the second ink. In one embodiment, a test pattern that includes a plurality of dots is printed to determine a clogged fluid ejection nozzle. Based on the determination, an actuator device corresponding to the clogged fluid ejection nozzle is pulsed.

1 Claim, 9 Drawing Sheets

BUBBLE PURGING SYSTEM FOR A FLUID EJECTION HEAD

This application claims priority and benefit as a division of U.S. patent application Ser. No. 12/618,042, having the same title, filed Nov. 13, 2009 now abandoned.

BACKGROUND

1. Field of the Invention

The present invention relates generally to a system and method for purging bubbles from a fluid ejection head and, more particularly to controlling the amount of ink ejected from the ejection head during a purging operation.

2. Description of the Related Art

Ink jet printers have a permanent fluid ejection head, which are not typically replaced by the customers. Rather, the supply item in this case that is replaced is the fluid cartridge mounted on the fluid ejection head. Air management in the fluid cartridge is an issue, since air can enter the fluid cartridge from several different sources resulting in blockage in the fluid ejection head that result in poor print quality if that air is not removed.

To purge bubbles, an air tight seal is provided around a plurality of fluid ejection nozzles of the fluid ejection head. The air tight seal has an opening at one end through which a negative pressure is exerted on the plurality of fluid ejection nozzles. The negative pressure removes ink and unwanted bubbles from the fluid ejection head. The fluidic resistance of the fluid ejection head determines the amount of ink removed during the purging operation. Some of the features that affect the fluidic resistance of ink are flow path length, area of the fluid ejection head, nozzle diameter, and fluid viscosity. Usually, there are significant differences in the flow features and fluid viscosity of monochrome ink compared to color ink.

Due to these differences, when the same pressure is applied to the monochrome ink and color ink during a purging operation, one of the color or monochrome ink is removed more than is needed.

Therefore, it would be advantageous to have a system that can control the amount of ink removed from the fluid ejection head during a purging operation.

SUMMARY OF THE INVENTION

Disclosed herein is a fluid ejection head including a plurality of fluid flow channels that includes a first plurality of fluid flow channels for flow of a first ink and a second plurality of fluid flow channels for flow of a second ink, the first ink being different from the second ink, a plurality of actuator devices including at least a first actuator device in thermal communication with the first plurality of fluid flow channels for heating the first ink, and at least a second actuator device in thermal communication with the second plurality of fluid flow channels for heating the second ink, a plurality of ink vias formed within the plurality of actuator devices, the plurality of ink vias in fluid communication with the first and second plurality of fluid flow channels, a nozzle plate attached to the plurality of actuator devices, the nozzle plate containing a plurality of fluid ejection nozzles corresponding to the plurality of ink vias, and a printer cap positioned adjacent the nozzle plate, the at least the first actuator device being pulsed with a first energy that depends on a viscosity of the first ink, the at least the second actuator device being pulsed with a second energy that depends on a viscosity of the second ink, the first energy being different from the second energy, a negative pressure being applied through the printer cap for purging bubbles from the first plurality of fluid flow channels, the second plurality of fluid flow channels, the plurality of ink vias, and the plurality of fluid ejection nozzles.

In some embodiments, pulsing the at least the first actuator device with the first energy and pulsing the at least the second actuator device with the second energy results in the viscosity of the first ink to be same as the viscosity of second ink.

In another aspect, a method for purging bubbles from a plurality of fluid flow channels and a plurality of ink vias of a fluid ejection head, the method includes pulsing the at least the first actuator device with a first energy, pulsing the at least the second actuator device with a second energy, and applying a negative pressure through the printer cap to purge bubbles from the first plurality of fluid flow channels, the second plurality of fluid flow channels, the plurality of ink vias, and the plurality of fluid ejection nozzles, the first energy being different from the second energy, the first energy and the second energy depending on the viscosity of the first ink and the second ink.

In yet another aspect, a method for purging bubble clogged in fluid ejection nozzles of a fluid ejection head, the method includes printing a pattern comprising a plurality of dots, each of the plurality of dots represents fluid ejection from the plurality of fluid ejection nozzles, scanning the pattern to determine missing one of the plurality of dots in the pattern, the missing one of the plurality of dots being indicative of a clog in one of the plurality of the fluid ejection nozzles, pulsing the actuator device associated with the clogged fluid ejection nozzle, and applying a negative pressure through the printer cap to purge the bubble from the clogged fluid ejection nozzle.

Additional features and advantages of the invention will be set forth in the detailed description which follows, and in part will be readily apparent to those skilled in the art from that description or recognized by practicing the invention as described herein, including the detailed description, which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent will be better understood by reference to the accompanying drawings, wherein.

DETAILED DESCRIPTION

Figure 1:
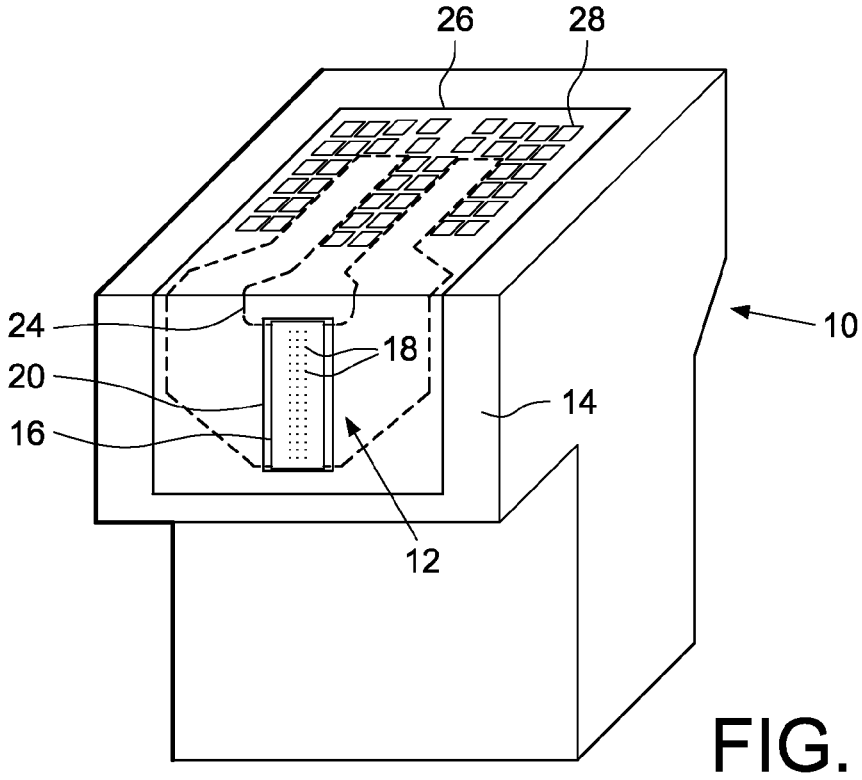
FIG. 1 is a perspective view of one embodiment of a fluid ejection head body including a fluid ejection head according to the present invention.

Reference will now be made in detail to the exemplary embodiment(s) of the invention, as illustrated in the accompanying drawings. Whenever possible, the same reference numerals will be used throughout the drawings to refer to the same or like parts.

Figure 3:
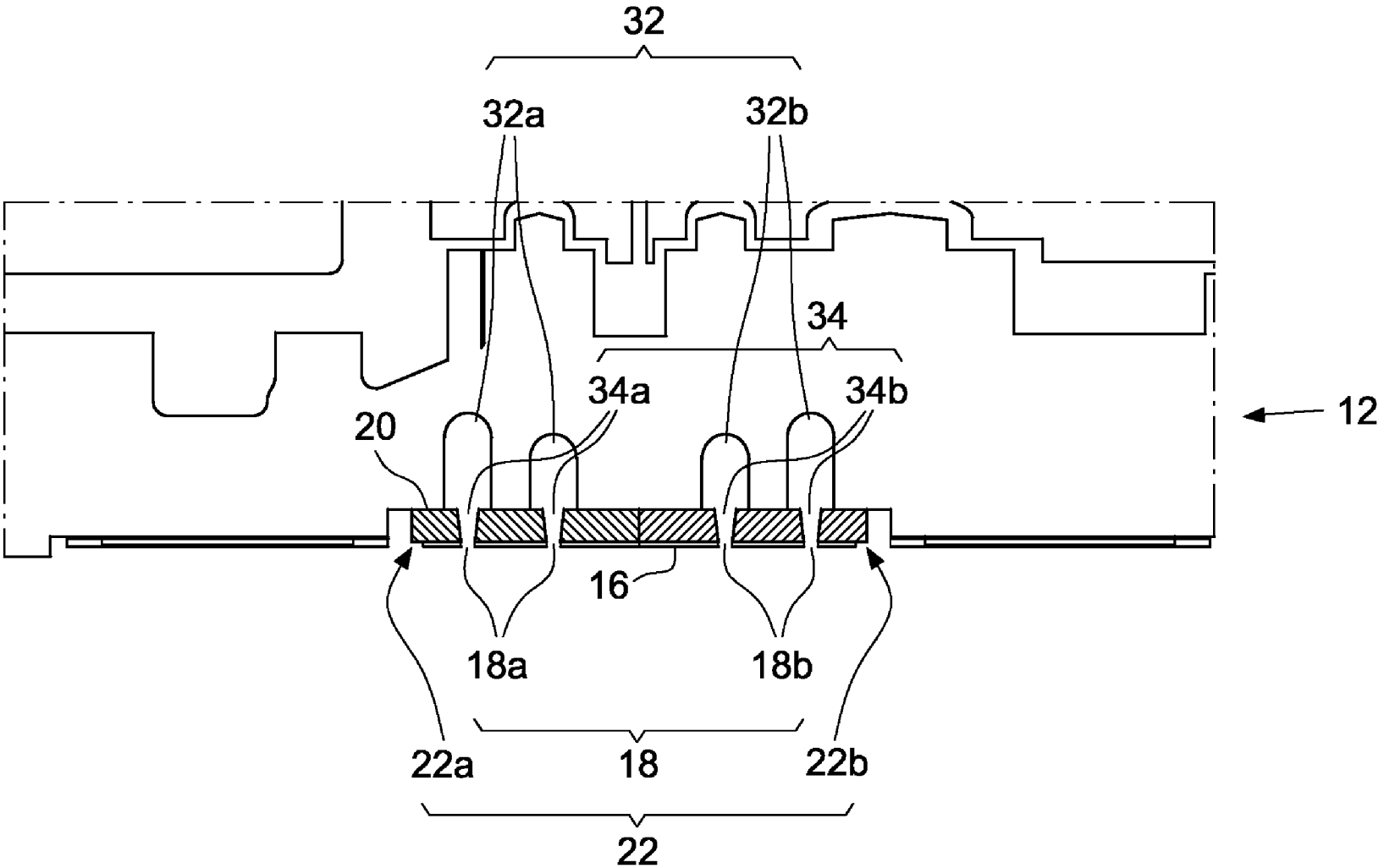
FIG. 3 illustrates a sectional view of the fluid ejection head of FIG. 1.

FIG. 1 is a perspective view of a fluid ejection head body 10, including a fluid ejection head 12 disposed on an ejection head area 14 of the fluid ejection head body 10. The fluid ejection head 12 includes a nozzle plate 16, containing a plurality of fluid ejection nozzles 18, attached to a substrate 20 containing actuator devices 22 (FIG. 3). Power is provided to the actuator devices 22 on the substrate 20 by electrical tracing 24 and a flexible circuit 26 containing electrical contact pads 28.

Figure 2:
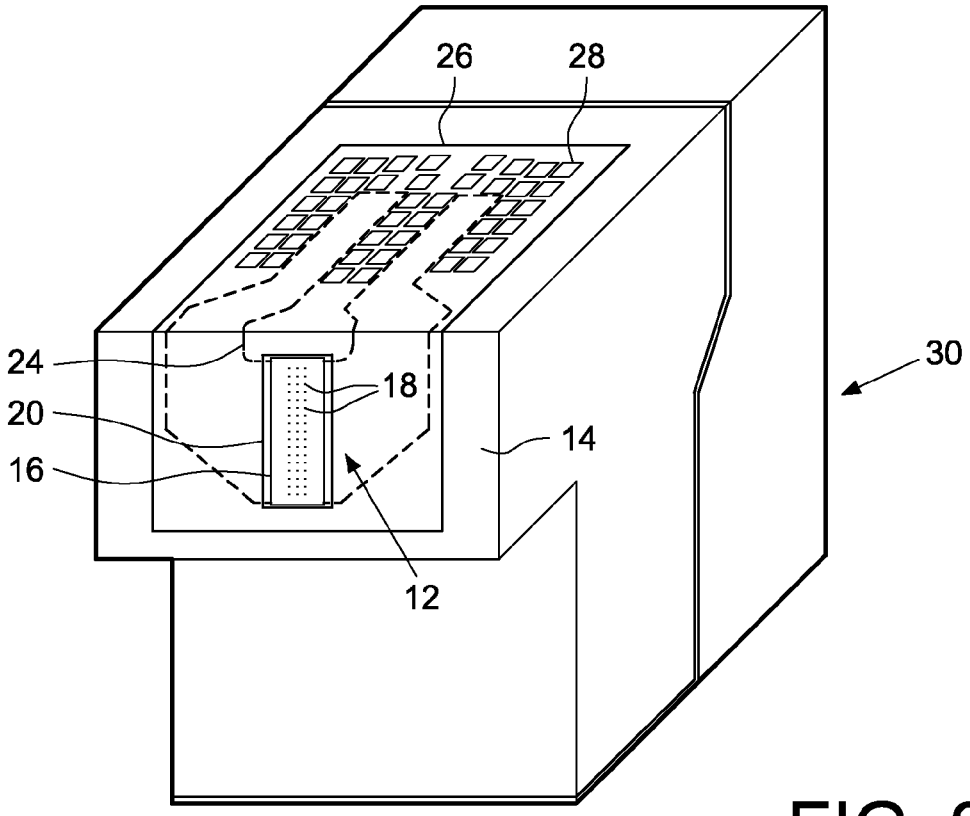
FIG. 2 is a perspective view of a fluid cartridge mounted on the fluid ejection head body of FIG. 1.

FIG. 2 is a perspective view of a fluid cartridge 30 mounted on the fluid ejection head 12 of FIG. 1. The fluid ejection head 12 ejects fluids, such as ink, contained in the fluid cartridge 30.

FIG. 3 illustrates a sectional view of the fluid ejection head 12 of FIG. 1. The fluid ejection head 12 includes a plurality of fluid flow channels 32 that receive ink from the fluid cartridge 30. The plurality of fluid flow channels 32 may include a first plurality of fluid flow channels 32*a* that receive a first ink and a second plurality of fluid flow channels 32*b* that receive a second ink that is different from the first ink. In one embodiment, the first ink is a monochrome ink and the second ink is a color ink. In another embodiment, the first ink and the second ink are both color inks, but may be of different colors.

The fluid ejection head 12 also includes the plurality of actuator devices 22, formed on the substrate 20 attached to the fluid ejection head 12. The plurality of actuator devices 22 include a first actuator device 22*a* associated with the first plurality of fluid flow channels 32*a* and a second actuator device 22*b* associated with the second plurality of fluid flow channels 32*b*. The actuator devices 22 are preferably heater resistor devices.

A plurality of ink vias 34 are formed within the plurality of actuator devices 22. The plurality of ink vias 34 include a first plurality of ink vias 34*a* that are in fluid communication with the first plurality of fluid flow channels 32*a*, and a second plurality of ink vias 34*b* that are in fluid communication with the second plurality of fluid flow channels 32*b*.

The fluid ejection head 12 also includes a nozzle plate 16 attached to the substrate 20. The nozzle plate 16 includes the plurality of fluid ejection nozzles 18 formed within the nozzle plate 16. As shown, the fluid ejection nozzles 18*a* and 18*b* are associated with the ink vias 34*a* and 34*b*, respectively.

Air bubbles may be formed in the ink present in the plurality of fluid flow channels 32, the plurality of ink vias 34, and/or the plurality of fluid ejection nozzles 18. If these air bubbles are not removed, they may block or inhibit the flow of fluid from the fluid flow channels 32 to the ink vias 34, or from the ink vias 34 to the plurality of fluid ejection nozzles 18, causing poor print quality.

Figure 4:
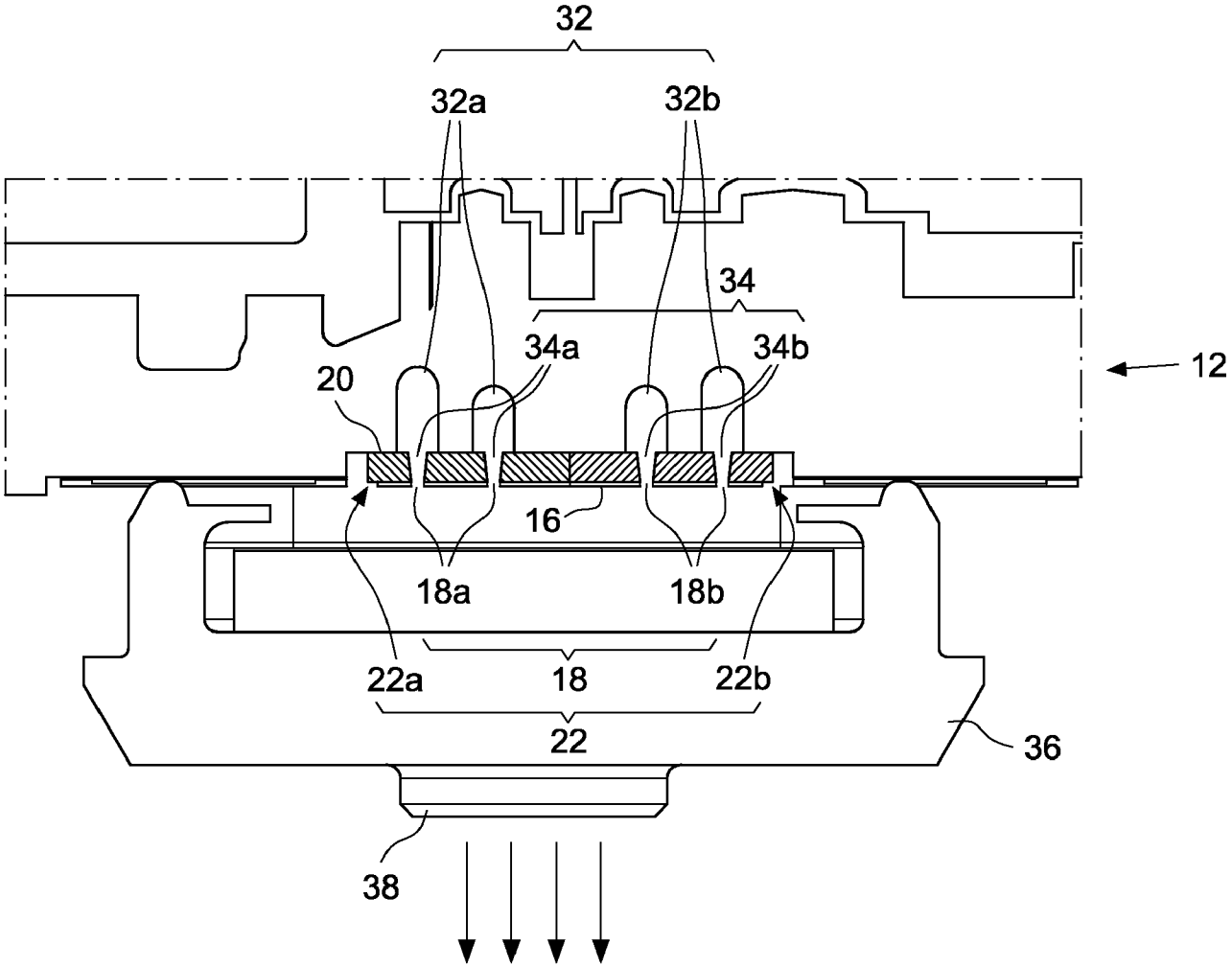
FIG. 4 illustrates a sectional view of one embodiment of the fluid ejection head and a printer cap according to the present invention.

FIG. 4 illustrates a sectional view of the fluid ejection head 12 and a printer cap 36 attached to the fluid ejection head 12 for purging bubbles from the plurality of fluid flow channels 32, the plurality of ink vias 34, and/or the plurality of fluid ejection nozzles 18. The printer cap 36 provides an air tight seal for the fluid ejection head 12. The printer cap 36 has an opening 38 through which a negative pressure is applied. This negative pressure purges bubbles and ink from the plurality of fluid flow channels 32, the plurality of ink vias 34, and the plurality of fluid ejection nozzles 18. The amount of ink removed during a bubble purging operation depends on the area of the fluid flow channel 32, diameter of the fluid ejection nozzles 18, and the viscosity of the inks flowing in the plurality of fluid flow channels 32.

Figure 5A:
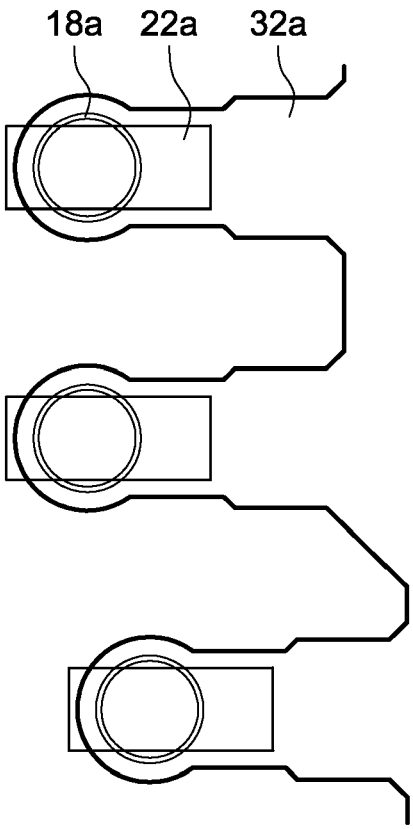
FIGS. 5*a*-5*b* illustrate a plan view of one embodiment of a partial portion of the fluid ejection head showing fluid flow channels, fluid ejection nozzles, and actuator device for monochrome ink and color ink according to the present invention.
Figure 5B:
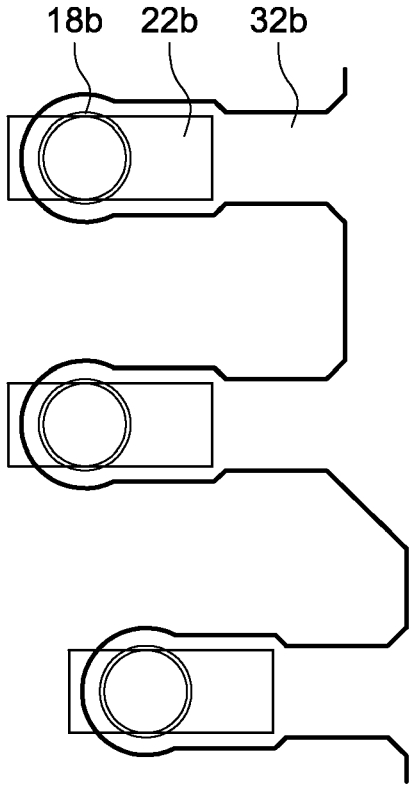

FIGS. 5*a*-5*b* illustrate a plan view of one embodiment of a partial portion of the fluid ejection head 12 showing the plurality of fluid flow channels 32, the plurality of fluid ejection nozzles 18, and the plurality of actuator devices 22 for monochrome ink and color ink, respectively, according to the present invention. As a larger ink drop size of a monochrome ink is desired compared to the ink drop size of a color ink, the size of flow features, i.e., size of the fluid flow channel 32*a*, and the diameter of the fluid ejection nozzle 18*a* for a monochrome ink is comparatively larger than the size of flow features, i.e., size of the fluid flow channel 32*b* and the diameter of the fluid ejection nozzle 18*b* for a color ink. Further, the viscosity of color ink is different from the viscosity of monochrome ink.

Due to the difference in the flow features and the viscosity of color ink and monochrome ink, when the same negative pressure is applied for purging bubbles from the color ink and the monochrome ink, one of the inks is removed more than is needed to ensure that the bubbles is removed. The present invention alleviates the problem of removing excess ink by pulsing the actuator device 22*a* associated with the first plurality of fluid flow channels 32*a* with a first energy and pulsing the actuator device 22*b* associated with the second plurality of fluid flow channels 32*b* with a second energy that is different from the first energy. The first energy and the second energy are based on the viscosity of the first ink and the second ink, respectively, to ensure that the flow rates of different inks can be controlled independently, and more or less ink of a selected color can be removed during the purge operation while applying the same pressure over the same time span for all the inks.

Figure 6:
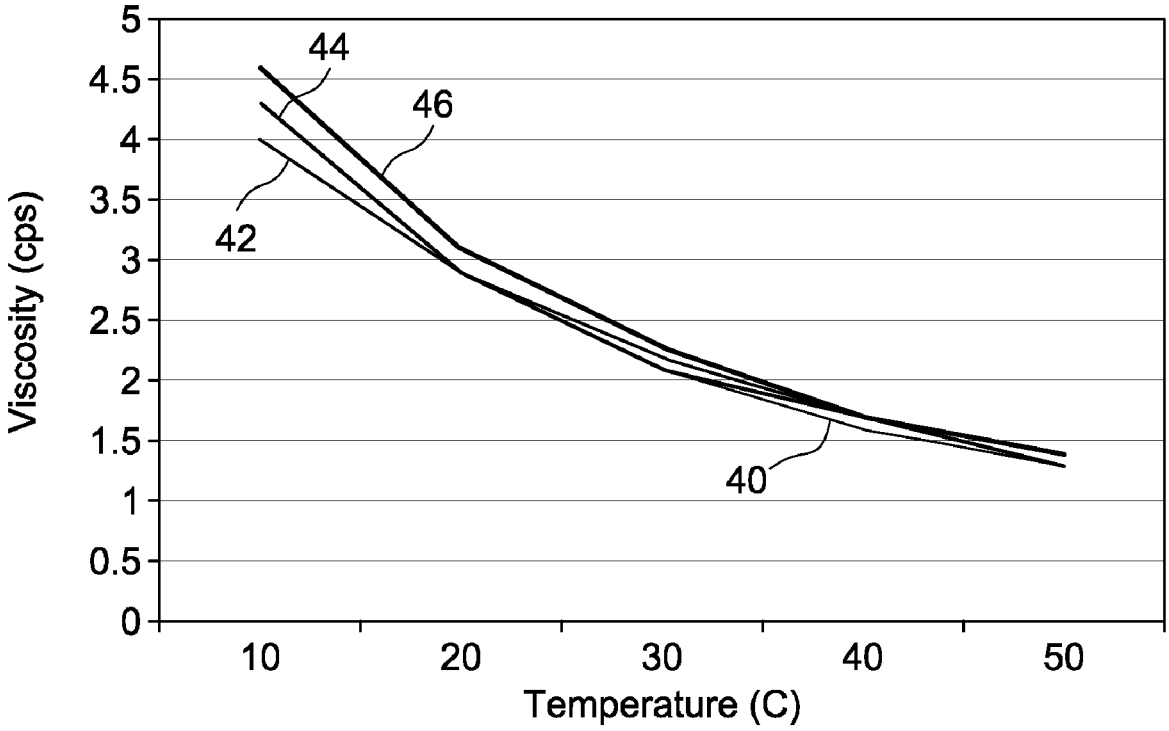
FIG. 6 is a graphical representation of a change in viscosity of ink with change in temperature.

FIG. 6 is a graphical representation of a change in viscosity of ink with a change in temperature. The graph shows this change in the viscosity of ink with the change in temperature for four inks cyan ink 40, black ink 42, yellow ink 46, and magenta ink 48. This information is stored in firmware (not shown) of an image forming device (not shown) that includes the fluid ejection head 12.

Figure 7:
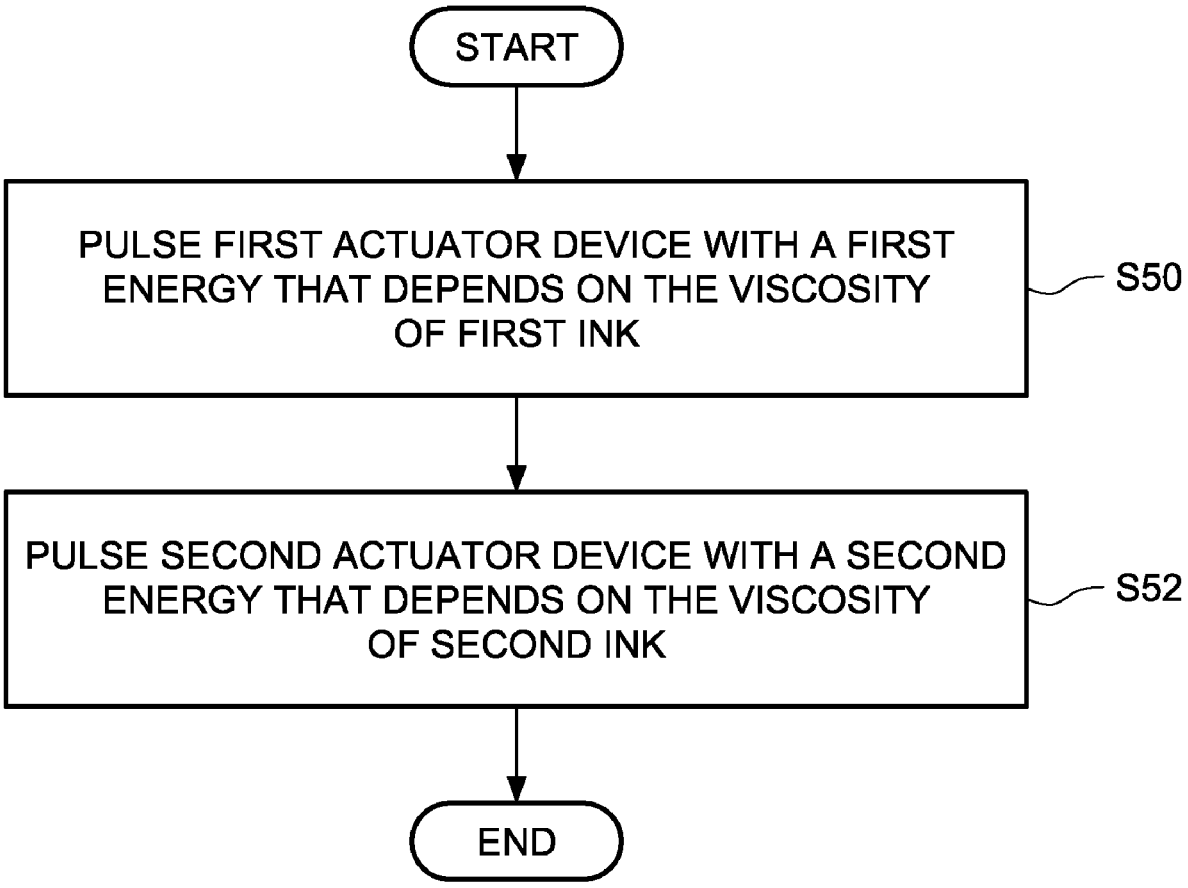
FIG. 7 illustrates one embodiment of processing steps for purging bubbles from the fluid ejection head according to the present invention.

FIG. 7 illustrates one embodiment of the processing steps for purging bubbles from the fluid ejection head 12 according to the present invention. At step S50 the first actuator device 22*a* that is in thermal communication with the first plurality of fluid flow channels 32*a* is pulsed with a first energy. The first energy heats the first ink flowing in the first plurality of fluid flow channels 32*a*. The first energy with which the first actuator device 22*a* is pulsed is determined based on the relationship between changes in viscosity of the first ink with the change in temperature stored in the firmware. The first energy changes the viscosity of the first ink such that only a desired amount of first ink is purged out during the purging of bubbles present in the first plurality of fluid flow channels 32*a*, plurality of ink vias 34*a* in fluid communication with the first plurality of fluid flow channels 32*a*, and the fluid ejection nozzles 18*a* in communication with the ink vias 34*a*.

At step S52 the second actuator device 22*b* that is in thermal communication with the second plurality of fluid flow channels 32*b* is pulsed with a second energy. The second energy heats the second ink flowing through the second plurality of fluid flow channels 32*b*. The second energy with which the second actuator device 22*b* is pulsed is determined based on the relationship between changes in viscosity of the second ink with the change in temperature stored in the firmware. The second energy changes the viscosity of the second ink such that only a desired amount of second ink is purged out during the purging of bubbles present in the second plurality of fluid flow channels 32*b*, the plurality of ink vias 34*b* in fluid communication with the second plurality of fluid flow channels 32*b*, and the fluid ejection nozzles 18*b* in communication with the ink vias 34*b*.

Heating the first ink and the second ink with the first energy and the second energy that depend on the viscosity of the first ink and the second ink, results in the viscosity of the first ink to be same as the viscosity of the second ink. This ensures that an excess amount of either the first ink or the second ink is not purged out when same the negative pressure is applied through the printer cap 36 for purging bubbles present in the plurality of fluid flow channels 32, the plurality of ink vias 34 in fluid communication with the plurality of fluid flow channels 32, and the fluid ejection nozzles 18 in communication with the ink vias 34. Although, the method discussed here is only for two inks, purging bubbles from any number of inks having different viscosities by heating the inks based on their viscosity would fall within the scope of the invention.

Figure 8:
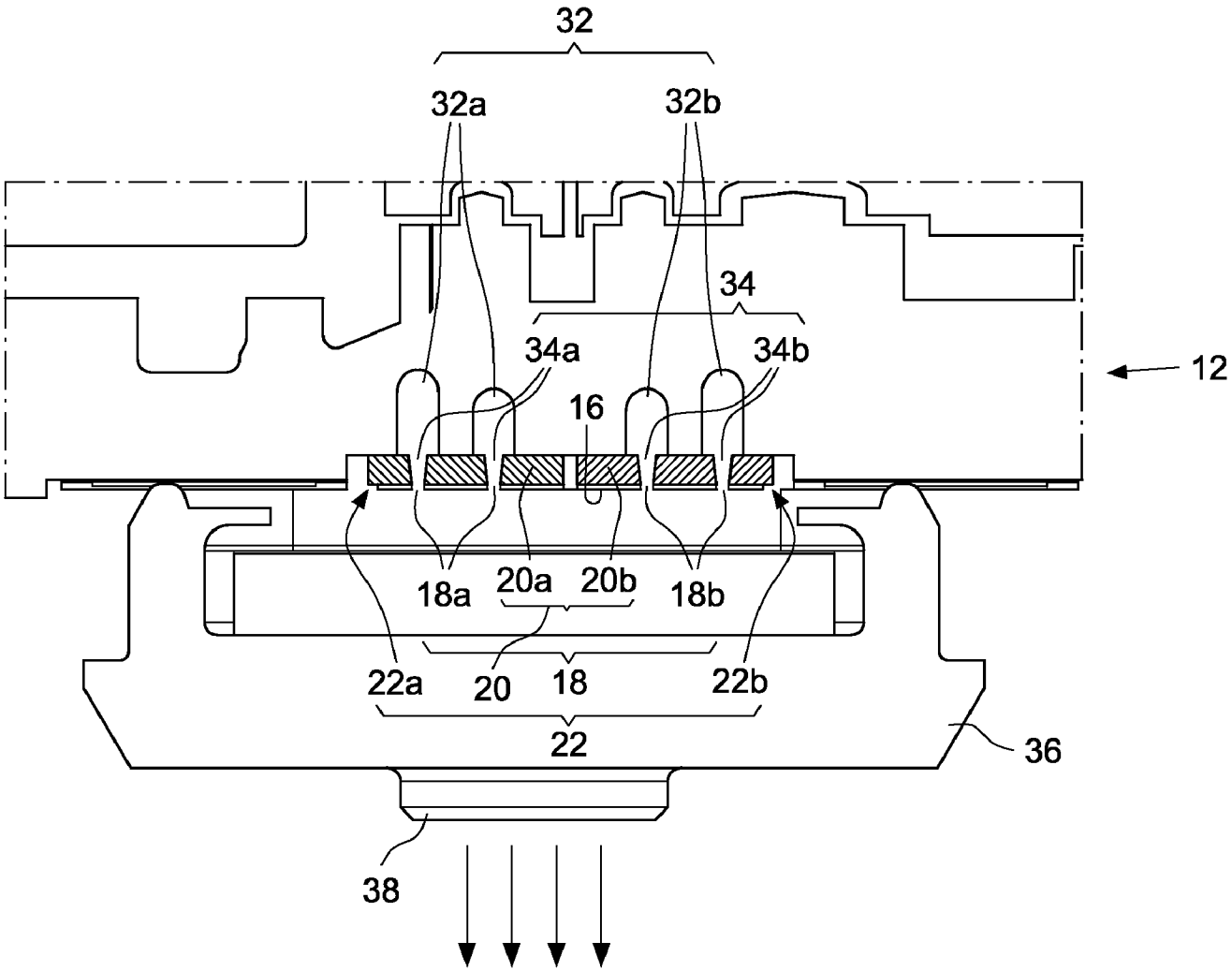
FIG. 8 illustrates a sectional view of one embodiment of the fluid ejection head and the printer cap with the actuator devices on separate substrates according to the present invention.

FIG. 8 illustrates a sectional view of one embodiment of the fluid ejection head 12 and the printer cap 36 according to the present invention. As shown, the first actuator device 22*a* is provided on a first substrate 20*a* and the second actuator device 22*b* is provided on a second substrate 20*b* separated from the first substrate 20*a*. Providing the first actuator device 22*a* and the second actuator device 22*b* on different substrates thermally isolates the actuator device 32*a* from each other, resulting in better and more accurate heating of the inks and thus better control on the amount of ink purged during a bubble purging operation.

Figure 9:
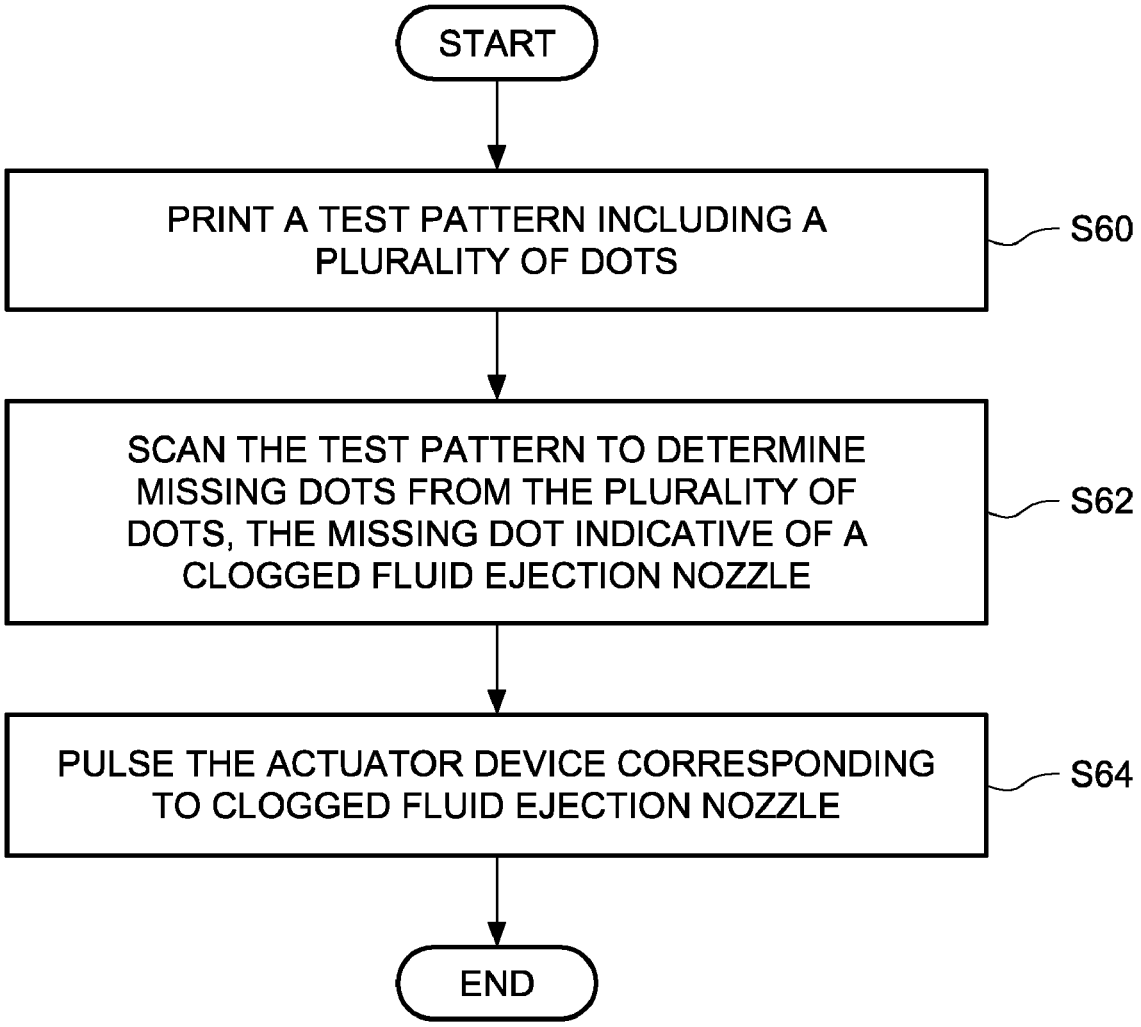
FIG. 9 illustrates one embodiment of processing steps for detecting clogged fluid ejection nozzles and purging bubbles from the clogged fluid ejection nozzles according to the present invention.

FIG. 9 illustrates one embodiment of processing steps for detecting clogs, if any, in the fluid ejection nozzles 18 and purging bubbles from the clogged fluid ejection nozzles 18 according to the present invention. Initially at step S60, a test pattern is printed by the fluid ejection head 12. The test pattern includes a plurality of dots of different colors (two colors in case of two inks). Each dot is representational of one of the plurality of fluid ejection nozzles 18. At step S62, the test pattern is scanned and a determination is made that if there are any missing dots from the plurality of dots in the test pattern. The missing dots are representational of a clog in the corresponding fluid ejection nozzle (18*a*, 18*b*). For example, in case the missing dots are of a color of the first ink that flows in the first plurality of fluid flow channels 32*a*, the fluid ejection nozzles 18*a* that are in fluid communication with the first plurality of fluid flow channels 32*a* are the clogged fluid ejection nozzles. At step S64, the actuator device 22*a* that corresponds to the clogged fluid ejection nozzles 18*a* is pulsed. Finally, a negative pressure is applied through the printer cap 36 to purge the bubble clogged in the fluid ejection nozzle 18*a*.

Figure 10:
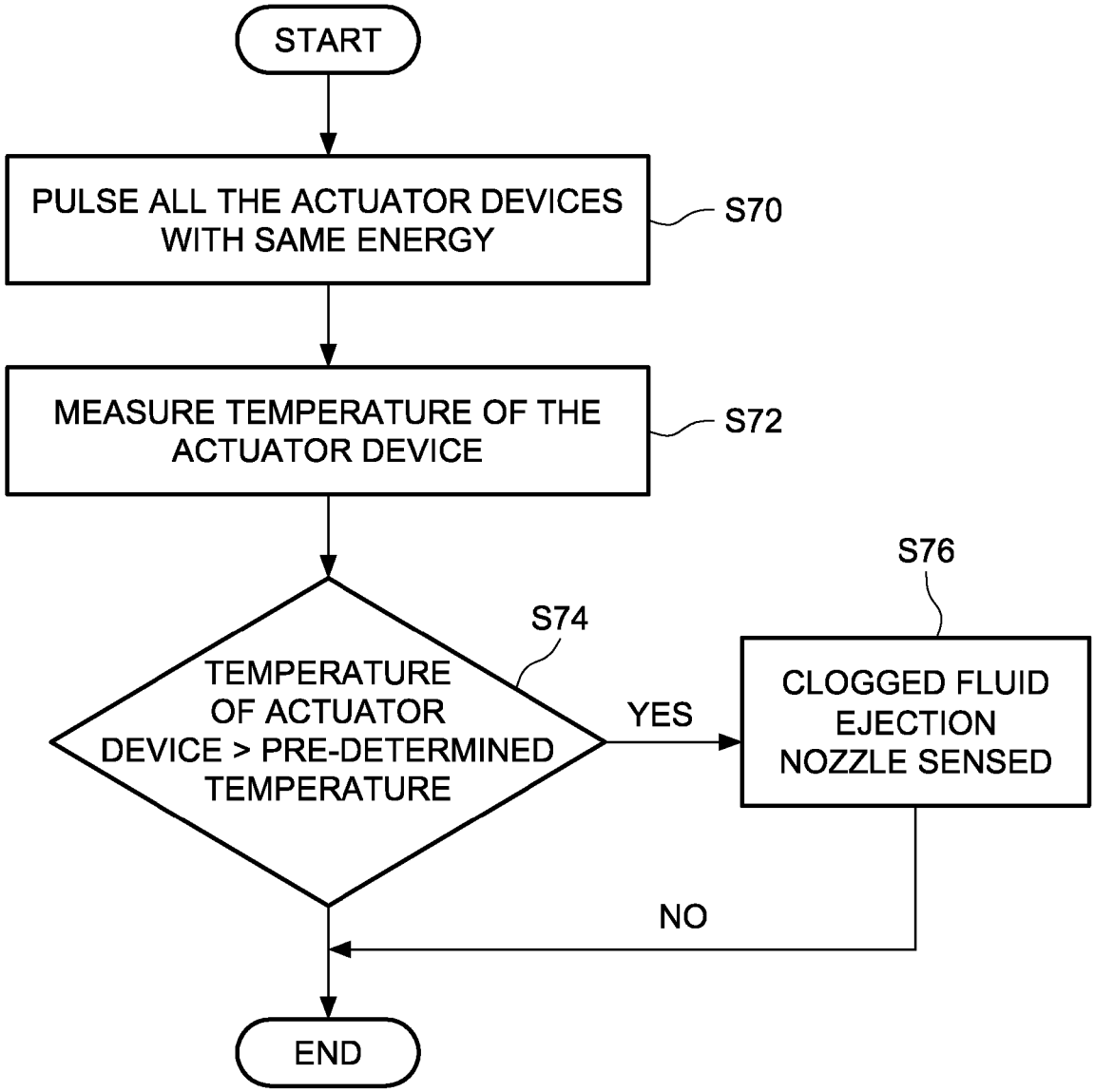
FIG. 10 illustrates another embodiment of processing steps for detecting a clogged fluid ejection nozzle according to the present invention.

FIG. 10 illustrates another embodiment of processing steps for detecting a clog in the plurality of fluid ejection nozzles 18 of the fluid ejection head 12 according to the present invention. At step S70, the plurality of actuator devices 22 are pulsed with a constant energy to heat the ink flowing through the plurality of fluid flow channels 32. At step S72, the temperature of the plurality of actuator devices 22 is measured. If the temperature of the plurality of actuator devices 22 is greater than a predetermined steady state temperature (step S74), the plurality of fluid ejection nozzles 18 is determined as clogged (step S76). In case the plurality of fluid ejection nozzles 18 are not clogged, the heat from the plurality of actuator devices 32 is removed by the ink flowing out through the plurality of fluid ejection nozzles 18 when negative pressure is applied through the printer cap 36, resulting in the temperature of the plurality of actuator devices 32 to be at the steady state temperature. However, in case of a clog in the plurality of fluid ejection nozzles 18, ink cannot flow out from the fluid ejection head 12 and remove the heat when negative pressure is applied through the printer cap 36, resulting in the temperature of the actuator devices 22 to be higher than the steady state temperature. This temperature information is then used to direct the customer to replace or repair the fluid ejection head 12.

The above described method of clog detection can also be utilized to determine a "deprime" situation, i.e., a situation when the plurality of fluid ejection nozzles 18 are filled only with air. This situation can arise, if the fluid cartridge 30 is not properly mounted on the fluid ejection head 12 or if there is a leak in the fluid ejection head 12 causing air to be filled in the fluid ejection nozzles 18. The deprime situation of the fluid ejection head 12 can be detected similar to the clog situation, by pulsing the plurality of actuator devices 22. If the plurality of fluid ejection nozzles 18 are filled with air heat would not be removed from the fluid ejection head 12 when negative pressure is applied through the printer cap 36, resulting in the temperature of the actuator devices 22 to be higher than the steady state temperature. This temperature information is then used to direct the customer to replace or repair the fluid ejection head 12.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

The invention claimed is:

1. A method for purging bubbles from a plurality of fluid flow channels, a plurality of fluid ejection nozzles, and a plurality of ink vias of a fluid ejection head, the fluid ejection head comprising the plurality of fluid flow channels including a first plurality of fluid flow channels for flow of a first ink and a second plurality of fluid flow channels for flow of a second ink, the first ink being different from the second ink, a plurality of actuator devices including at least a first actuator device in thermal communication with the first plurality of fluid flow channels for heating the first ink, and at least a second actuator device in thermal communication with the second plurality of fluid flow channels for heating the second ink, the plurality of ink vias formed within the plurality of actuator devices, the plurality of ink vias in fluid communication with the plurality of fluid flow channels, a nozzle plate attached to the plurality of actuator devices, the nozzle plate containing the plurality of fluid ejection nozzles corresponding to the plurality of ink vias, and a printer cap positioned adjacent the nozzle plate, the method comprising:

pulsing the at least the first actuator device with a first energy to heat the first ink to a first viscosity;

pulsing the at least the second actuator device with a second energy to heat the second ink to a viscosity the same as the first viscosity; and upon the viscosity of the second ink being the same as the first viscosity of the first ink, applying a negative pressure through the printer cap to purge bubbles in the first and second inks from the first plurality of fluid flow channels, the second plurality of fluid flow channels, the plurality of ink vias, and the plurality of fluid ejection nozzles to minimize an amount of the first and second inks that are purged, the first energy being different from the second energy and the first plurality of fluid flow channels for flow of the first ink being larger than the second plurality of fluid flow channels for flow of the second ink.

* * * * *